US010106301B2

(12) United States Patent
Schulz et al.

(10) Patent No.: US 10,106,301 B2
(45) Date of Patent: Oct. 23, 2018

(54) FLEXIBLE CONTAINER WITH SPOUT

(71) Applicant: Dow Global Technologies LLC, Midland, MI (US)

(72) Inventors: Peter J. Schulz, Midland, MI (US); Lamy J. Chopin, III, Missouri City, TX (US); Michelle L. Boven, Katy, TX (US); Jeffrey E. Bonekamp, Midland, MI (US)

(73) Assignee: Dow Global Technologies LLC, Midland, MI (US)

( * ) Notice: Subject to any disclaimer, the term of this patent is extended or adjusted under 35 U.S.C. 154(b) by 130 days.

(21) Appl. No.: 15/251,630

(22) Filed: Aug. 30, 2016

(65) Prior Publication Data

US 2018/0057225 A1 Mar. 1, 2018

(51) Int. Cl.

| | |
|---|---|
| ***B65D 47/36*** | (2006.01) |
| ***B65D 33/01*** | (2006.01) |
| ***B65D 33/08*** | (2006.01) |
| ***B65D 75/00*** | (2006.01) |
| ***B65D 75/56*** | (2006.01) |
| ***B65D 75/58*** | (2006.01) |

(52) U.S. Cl.

CPC ..... *B65D 47/36* (2013.01); *B65D 33/01* (2013.01); *B65D 33/08* (2013.01); *B65D 75/008* (2013.01); *B65D 75/566* (2013.01); *B65D 75/5866* (2013.01); *B65D 2207/00* (2013.01)

(58) Field of Classification Search

CPC ..... B65D 47/36; B65D 33/01; B65D 33/08; B65D 75/008; B65D 75/566; B65D 75/5866; B65D 2207/00

USPC ..... 220/666, 62.11; 222/105, 96, 95, 92, 222/572; 383/10, 7, 6, 906, 120, 66; 215/900

See application file for complete search history.

(56) References Cited

U.S. PATENT DOCUMENTS

| | | | |
|---|---|---|---|
| 5,677,383 | A | 10/1997 | Chum et al. |
| 5,783,638 | A | 7/1998 | Lai et al. |
| 6,111,023 | A | 8/2000 | Chum et al. |

(Continued)

FOREIGN PATENT DOCUMENTS

| | | | |
|---|---|---|---|
| FR | 2839295 | A1 | 11/2003 |
| JP | 4103331 | B2 | 6/2008 |

(Continued)

*Primary Examiner* — Anthony Stashick
*Assistant Examiner* — James M Van Buskirk
(74) *Attorney, Agent, or Firm* — Husch Blackwell LLP

(57) ABSTRACT

The present disclosure provides a flexible container. In an embodiment, the flexible container includes (A) four panels adjoined along a common peripheral seal. The common peripheral seal is composed of a first side seal, an opposing second side seal, a top seal, and an opposing bottom seal. The four seals form a chamber. (B) Each panel includes a bottom face, and the four bottom faces are sealed together to define a bottom section. The flexible container includes (C) an upper spout seal extending from the first side seal to the second side seal. The flexible container also includes (D) a lower spout seal. (E) The upper spout seal and the lower spout seal each include a respective spout seal segment and a respective chamber seal segment. (F) The chamber seal segments define a sealed chamber top. (G) The lower spout seal segment is reciprocally aligned with the upper spout seal segment to form a spout. The spout extends from the sealed chamber top to the second side seal.

20 Claims, 8 Drawing Sheets

(56) References Cited

U.S. PATENT DOCUMENTS

| | | | |
|---|---|---|---|
| 6,984,695 | B2 | 1/2006 | Brown et al. |
| 8,002,468 | B2 | 8/2011 | Otsuka et al. |
| 8,348,509 | B2 | 1/2013 | Wilkes et al. |
| 8,992,084 | B2 | 3/2015 | Pellingra et al. |
| 2008/0253700 | A1 | 10/2008 | Sh |

FOREIGN PATENT DOCUMENTS

| | | | |
|---|---|---|---|
| WO | 2007147568 | A1 | 12/2007 |
| WO | 2008146142 | A1 | 12/2008 |
| WO | 2009/016654 | A2 | 2/2009 |

FLEXIBLE CONTAINER WITH SPOUT

BACKGROUND

The present disclosure is directed to a flexible container for dispensing a flowable material.

Known are flexible containers with a gusseted body section. These gusseted flexible containers are currently produced using flexible films which are folded to form gussets and heat sealed in a perimeter shape. The gusseted body section opens to form a flexible container with a square cross section or a rectangular cross section. The gussets are terminated at the bottom of the container to form a substantially flat base, providing stability when the container is partially or wholly filled. The gussets are also terminated at the top of the container to form an open neck for receiving a rigid fitment and closure.

Flexible containers with rigid fitments have several shortcomings. First, the cost of the rigid fitment typically exceeds the cost of the flexible container. Second, production steps to ensure a hermetic seal between the rigid fitment and the flexible container are time consuming and energy intensive, further impacting the overall viability of these fitment-type flexible containers. In sum, the rigid fitment itself and the production demands for fitment installation make flexible containers with rigid fitments impractical for many packaging applications, and impractical for many low-cost packaging applications in particular.

The art recognizes the need for a flexible container with a spout that does not require a rigid fitment. A need further exists for a flexible container that avoids a rigid fitment, yet has a pour spout, is a stand-up container, and is convenient to use.

SUMMARY

The present disclosure provides a flexible container. In an embodiment, the flexible container includes (A)four panels adjoined along a common peripheral seal. The common peripheral is composed of a first side seal, an opposing second side seal, a top seal, and an opposing bottom seal. The four seals form a chamber. (B) Each panel includes a bottom face, and the four bottom faces are sealed together to define a bottom section. The flexible container includes (C) an upper spout seal extending from the first side seal to the second side seal. The flexible container also includes (D) a lower spout seal. (E) The upper spout seal and the lower spout seal each include a respective spout seal segment and a respective chamber seal segment. (F) The chamber seal segments define a sealed chamber top. (G) The lower spout seal segment is reciprocally aligned with the upper spout seal segment to form a spout. The spout extends from the sealed chamber top to the second side seal.

The present disclosure provides another flexible container. In an embodiment, the flexible container includes (A) four panels adjoined along a common peripheral seal. The common peripheral seal is composed of a first side seal, an opposing second side seal, a top seal, and an opposing bottom seal. The four seals form a chamber. (B) Each panel includes a bottom face, the four bottom faces are sealed together to define a bottom section. The flexible container includes (C) an upper spout seal extending from the first side seal to the top seal. The flexible container further includes (D) a lower spout seal. (E) The upper spout seal and the lower spout seal each include a respective spout seal segment and a respective chamber seal segment. (F) The chamber seal segments define a sealed chamber top, and (G) the lower spout seal segment reciprocally aligns with the upper spout seal segment to form a spout. The spout extends from the sealed chamber top to the top seal.

DEFINITIONS

Figure 1:
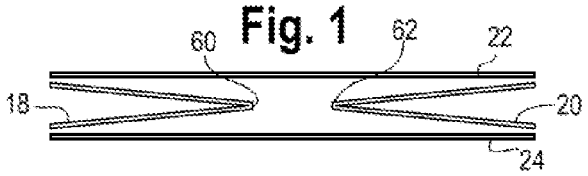
FIG. 1 is an exploded side elevation view of a panel sandwich.

The numerical ranges disclosed herein include all values from, and including, the lower value and the upper value. For ranges containing explicit values (e.g., 1, or 2, or 3 to 5, or 6, or 7) any subrange between any two explicit values is included (e.g., 1 to 2; 2 to 6; 5 to 7; 3 to 7; 5 to 6; etc.).

Unless stated to the contrary, implicit from the context, or customary in the art, all parts and percents are based on weight, and all test methods are current as of the filing date of this disclosure.

The term "composition," as used herein, refers to a mixture of materials which comprise the composition, as well as reaction products and decomposition products formed from the materials of the composition.

The terms "comprising," "including," "having," and their derivatives, are not intended to exclude the presence of any additional component, step or procedure, whether or not the same is specifically disclosed. In order to avoid any doubt, all compositions claimed through use of the term "comprising" may include any additional additive, adjuvant, or compound, whether polymeric or otherwise, unless stated to the contrary. In contrast, the term, "consisting essentially of" excludes from the scope of any succeeding recitation any other component, step or procedure, excepting those that are not essential to operability. The term "consisting of" excludes any component, step or procedure not specifically delineated or listed.

A "polymer" is a compound prepared by polymerizing monomers, whether of the same or a different type, that in polymerized form provide the multiple and/or repeating "units" or "mer units" that make up a polymer. The generic term polymer thus embraces the term homopolymer, usually employed to refer to polymers prepared from only one type of monomer, and the term copolymer, usually employed to refer to polymers prepared from at least two types of monomers. It also embraces all forms of copolymer, e.g., random, block, etc. The terms "ethylene/α-olefin polymer" and "propylene/α-olefin polymer" are indicative of copolymer as described above prepared from polymerizing ethylene or propylene respectively and one or more additional, polymerizable α-olefin monomer. It is noted that although a polymer is often referred to as being "made of" one or more specified monomers, "based on" a specified monomer or monomer type, "containing" a specified monomer content, or the like, in this context the term "monomer" is understood to be referring to the polymerized remnant of the specified monomer and not to the unpolymerized species. In general, polymers herein are referred to has being based on "units" that are the polymerized form of a corresponding monomer.

An "olefin-based polymer" is a polymer that contains more than 50 mole percent polymerized olefin monomer (based on total amount of polymerizable monomers), and optionally, may contain at least one comonomer. Non-limiting examples of olefin-based polymer include ethylene-based polymer and propylene-based polymer.

A "propylene-based polymer" is a polymer that contains more than 50 weight percent polymerized propylene monomer (based on the total weight of polymerizable monomers) and, optionally, may contain at least one comonomer.

An "ethylene-based polymer" is a polymer that contains more than 50 weight percent polymerized ethylene monomer (based on the total weight of polymerizable monomers) and, optionally, may contain at least one comonomer. Ethylene-based polymer includes ethylene homopolymer, and ethylene copolymer (meaning units derived from ethylene and one or more comonomers). The terms "ethylene-based polymer" and "polyethylene" may be used interchangeably. Non-limiting examples of ethylene-based polymer (polyethylene) include low density polyethylene (LDPE) and linear polyethylene. Non-limiting examples of linear polyethylene include linear low density polyethylene (LLDPE), ultra low density polyethylene (ULDPE), very low density polyethylene (VLDPE), multi-component ethylene-based copolymer (EPE), ethylene/α-olefin multi-block copolymers (also known as olefin block copolymer (OBC)), single-site catalyzed linear low density polyethylene (m-LLDPE), substantially linear, or linear, plastomers/elastomers, and high density polyethylene (HDPE). Generally, polyethylene may be produced in gas-phase, fluidized bed reactors, liquid phase slurry process reactors, or liquid phase solution process reactors, using a heterogeneous catalyst system, such as Ziegler-Natta catalyst, a homogeneous catalyst system, comprising Group 4 transition metals and ligand structures such as metallocene, non-metallocene metal-centered, heteroaryl, heterovalent aryloxyether, phosphinimine, and others. Combinations of heterogeneous and/or homogeneous catalysts also may be used in either single reactor or dual reactor configurations.

"High density polyethylene" (or "HDPE") is an ethylene homopolymer or an ethylene/α-olefin copolymer with at least one $C_4$-$C_{10}$ α-olefin comonomer, or $C_4$ α-olefin comonomer and a density from greater than 0.94 g/cc, or 0.945 g/cc, or 0.95 g/cc, or 0.955 g/cc to 0.96 g/cc, or 0.97 g/cc, or 0.98 g/cc. The HDPE can be a monomodal copolymer or a multimodal copolymer. A "monomodal ethylene copolymer" is an ethylene/$C_4$-$C_{10}$ α-olefin copolymer that has one distinct peak in a gel permeation chromatography (GPC) showing the molecular weight distribution. A "multimodal ethylene copolymer" is an ethylene/$C_4$-$C_{10}$ α-olefin copolymer that has at least two distinct peaks in a GPC showing the molecular weight distribution. Multimodal includes copolymer having two peaks (bimodal) as well as copolymer having more than two peaks. Nonlimiting examples of HDPE include DOW™ High Density Polyethylene (HDPE) Resins (available from The Dow Chemical Company), ELITE™ Enhanced Polyethylene Resins (available from The Dow Chemical Company), CONTINUUM™ Bimodal Polyethylene Resins (available from The Dow Chemical Company), LUPOLEN™ (available from LyondellBasell), as well as HDPE products from Borealis, Ineos, and ExxonMobil.

"Low density polyethylene" (or "LDPE") consists of ethylene homopolymer, or ethylene/α-olefin copolymer comprising at least one $C_3$-$C_{10}$ α-olefin, preferably $C_3$-$C_4$that has a density from 0.915 g/cc to 0.940 g/cc and contains long chain branching with broad MWD. LDPE is typically produced by way of high pressure free radical polymerization (tubular reactor or autoclave with free radical initiator). Nonlimiting examples of LDPE include MarFlex™ (Chevron Phillips), LUPOLEN™ (LyondellBasell), as well as LDPE products from Borealis, Ineos, ExxonMobil, and others.

"Linear low density polyethylene" (or "LLDPE") is a linear ethylene/α-olefin copolymer containing heterogeneous short-chain branching distribution comprising units derived from ethylene and units derived from at least one $C_3$-$C_{10}$ α-olefin comonomer or at least one $C_4$-$C_8$ α-olefin comonomer, or at least one $C_6$-$C_8$ α-olefin comonomer. LLDPE is characterized by little, if any, long chain branching, in contrast to conventional LDPE. LLDPE has a density from 0.910 g/cc, or 0.915 g/cc, or 0.920 g/cc, or 0.925 g/cc to 0.930 g/cc, or 0.935 g/cc, or 0.940 g/cc. Nonlimiting examples of LLDPE include TUFLIN™ linear low density polyethylene resins (available from The Dow Chemical Company), DOWLEX™ polyethylene resins (available from the Dow Chemical Company), and MARLEX™ polyethylene (available from Chevron Phillips).

"Ultra low density polyethylene" (or "ULDPE") and "very low density polyethylene" (or "VLDPE") each is a linear ethylene/α-olefin copolymer containing heterogeneous short-chain branching distribution comprising units derived from ethylene and units derived from at least one $C_3$-$C_{10}$ α-olefin comonomer, or at least one $C_4$-$C_8$ α-olefin comonomer, or at least one $C_6$-$C_8$ α-olefin comonomer. ULDPE and VLDPE each has a density from 0.885 g/cc, or 0.90 g/cc to 0.915 g/cc. Nonlimiting examples of ULDPE and VLDPE include ATTANE™ ultra low density polyethylene resins (available form The Dow Chemical Company) and FLEXOMER™ very low density polyethylene resins (available from The Dow Chemical Company).

"Multi-component ethylene-based copolymer" (or "EPE") comprises units derived from ethylene and units derived from at least one $C_3$-$C_{10}$ α-olefin comonomer, or at least one $C_4$-$C_8$ α-olefin comonomer, or at least one $C_6$-$C_8$ α-olefin comonomer, such as described in patent references U.S. Pat. No. 6,111,023; U.S. Pat. No. 5,677,383; and U.S. Pat. No. 6,984,695. EPE resins have a density from 0.905 g/cc, or 0.908 g/cc, or 0.912 g/cc, or 0.920 g/cc to 0.926 g/cc, or 0.929 g/cc, or 0.940 g/cc, or 0.962 g/cc. Nonlimiting examples of EPE resins include ELITE™ enhanced polyethylene (available from The Dow Chemical Company), ELITE Arm advanced technology resins (available from The Dow Chemical Company), SURPASS™ Polyethylene (PE)

Resins (available from Nova Chemicals), and SMART™ (available from SK Chemicals Co.).

"Olefin block copolymers" (or "OBC") are ethylene/α-olefin multi-block copolymers comprising units derived from ethylene and units derived from at least one $C_3$-$C_{10}$ α-olefin comonomer, or at least one $C_4$-$C_8$ α-olefin comonomer, or at least one $C_6$-$C_8$ α-olefin comonomer, such as INFUSE™ (available from The Dow Chemical Company) as described in U.S. Pat. No. 7,608,668. OBC resins have a density from 0.866 g/cc, or 0.870 g/cc, or 0.875 g/cc, or 0.877 g/cc to 0.880 g/cc, or 0.885, or 0.890 g/cc.

"Single-site catalyzed linear low density polyethylenes" (or "m-LLDPE") are linear ethylene/α-olefin copolymers containing homogeneous short-chain branching distribution comprising units derived from ethylene and units derived from at least one $C_3$-$C_{10}$ α-olefin comonomer, or at least one $C_4$-$C_8$ α-olefin comonomer, or at least one $C_6$-$C_8$ α-olefin comonomer. m-LLDPE has density from 0.913 g/cc, or 0.918 g/cc, or 0.920 g/cc to 0.925 g/cc, or 0.940 g/cc. Nonlimiting examples of m-LLDPE include EXCEED™ metallocene PE (available from ExxonMobil Chemical), LUFLEXEN™ m-LLDPE (available from LyondellBasell), and ELTEX™ PF m-LLDPE (available from Ineos Olefins & Polymers).

"Ethylene plastomers/elastomers" are substantially linear, or linear, ethylene/α-olefin copolymers containing homogeneous short-chain branching distribution comprising units derived from ethylene and units derived from at least one $C_3$-$C_{10}$ α-olefin comonomer, or at least one $C_4$-$C_8$ α-olefin comonomer, or at least one $C_6$-$C_8$ α-olefin comonomer. Ethylene plastomers/elastomers have a density from 0.870 g/cc, or 0.880 g/cc, or 0.890 g/cc to 0.900 g/cc, or 0.902 g/cc, or 0.904 g/cc, or 0.909 g/cc, or 0.910 g/cc, or 0.917 g/cc. Nonlimiting examples of ethylene plastomers/elastomers include AFFINITY™ plastomers and elastomers (available from The Dow Chemical Company), EXACT™ Plastomers (available from ExxonMobil Chemical), Tafmer™ (available from Mitsui), Nexlene™ (available from SK Chemicals Co.), and Lucene™ (available LG Chem Ltd.).

Density is measured in accordance with ASTM D 792 with values reported in grams per cubic centimeter, g/cc.

Melt flow rate (MFR) is measured in accordance with ASTM D 1238,Condition 280° C./2.16 kg with values reported in grams per 10 minutes, g/10 min.

Melt index (MI) is measured in accordance with ASTM D 1238, Condition 190° C./2.16 kg with values reported in grams per 10 minutes, g/10 min.

"Melting point" or "Tm" (also referred to as a melting peak in reference to the shape of the plotted DSC curve), as used herein, is typically measured by the DSC (Differential Scanning calorimetry) technique for measuring the melting points or peaks of polyolefins, as described in U.S. Pat. No. 5,783,638. It should be noted that many blends comprising two or more polyolefins will have more than one melting point or peak, many individual polyolefins will comprise only one melting point or peak. Melting point values are reported in degrees celsius, ° C.

DETAILED DESCRIPTION

1. Flexible Container

The present disclosure provides a flexible container. In an embodiment, the flexible container includes (A) four panels adjoined along a common peripheral seal. The common peripheral seal includes a first side seal, an opposing second side seal, a top seal and an opposing bottom seal. The four seals form a chamber. (B) Each panel includes a bottom face. The four bottom faces are sealed together to define a bottom section. (C) An upper spout seal extends from the first side seal to the second side seal. The flexible container includes (D) a lower spout seal. (E) The upper spout seal and the lower spout seal each comprise a respective spout seal segment and a respective chamber seal segment. (F) The chamber seal segments define a sealed chamber top. (G) The lower spout seal segment is reciprocally aligned with the upper spout seal segment to form a spout. The spout extends from the sealed chamber top to the second side seal.

A. Panels

The present flexible container is made from four panels. During the fabrication process, the panels are formed when one or more webs of flexible film material are sealed together. While the webs may be separate pieces of flexible film material, it will be appreciated that any number of the seams between the webs could be "pre-made," as by folding one or more of the source webs to create the effect of a seam or seams, For example, if it is desired to fabricate the present flexible container from two webs instead of four, the bottom, left center, and right center webs could be a single folded web, instead of three separate webs. Similarly, one, two, or more webs may be used to produce each respective panel (i.e., a bag-in-a-bag configuration or a bladder configuration).

Figure 2:
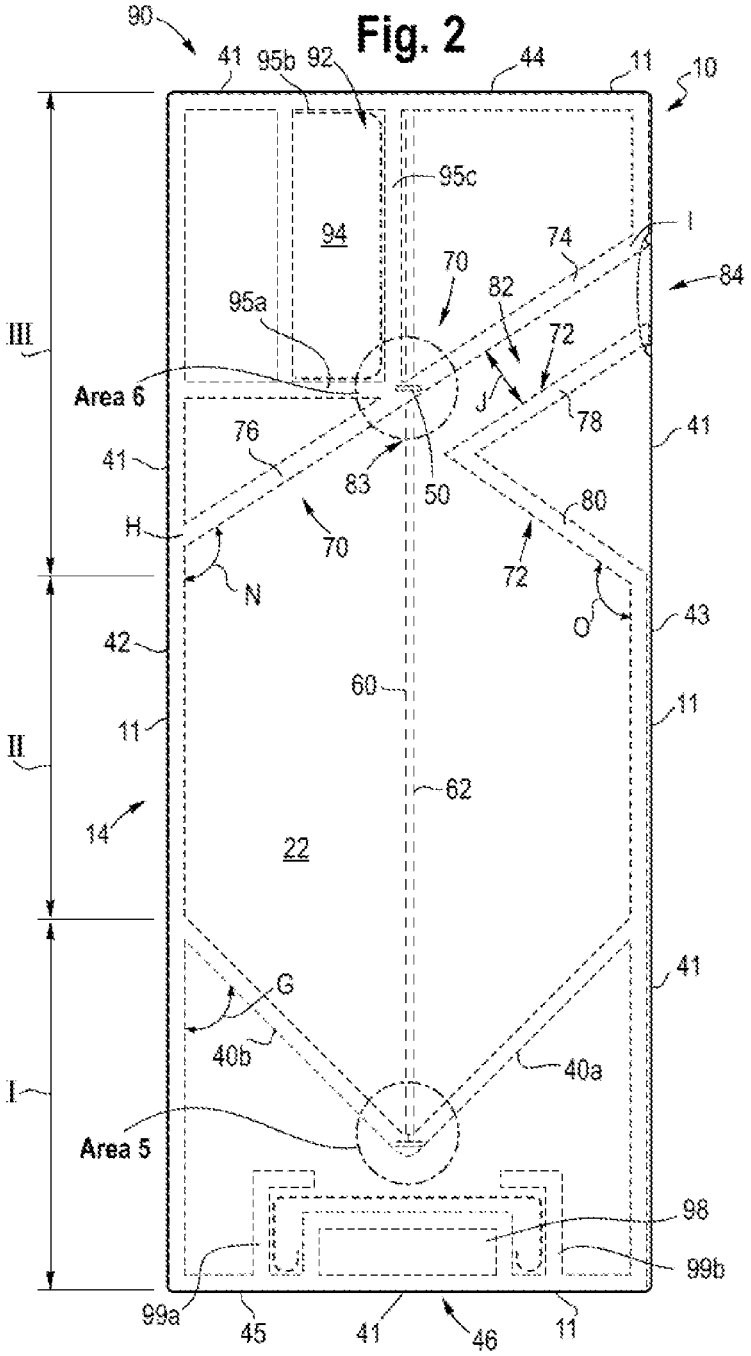
FIG. 2 is front elevation view of a flexible container in a collapsed configuration in accordance with an embodiment of the present disclosure.

FIG. 1 shows the relative positions of the four webs as they form four panels (in a "one up" configuration) as they pass through the fabrication process. For clarity, the webs are shown as four individual panels, the panels separated and the heat seals not made. The constituent webs form first gusset panel 18, second gusset panel 20, front panel 22 and rear panel 24. Each panel 18-24 is a flexible multilayer film as discussed in detail below. The gusset fold lines 60 and 62 are shown in FIGS. 1 and 2. Nonlimiting examples of suitable sealing procedures include heat sealing and/or ultrasonic sealing and/or adhesive sealing.

As shown in FIG. 1, the folded gusset panels 18, 20 are placed between the rear panel 24 and the front panel 22 to form a "panel sandwich." The gusset panel 18 opposes the gusset panel 20. The edges of the panels 18-24 are configured, or otherwise arranged, to form a common periphery 11 as shown in FIG. 2. The flexible multilayer film of each panel web is configured so that the heat seal layers face each other. The common periphery 11 includes the bottom seal area including the bottom end of each panel.

When the flexible container 10 is in the collapsed configuration, as shown in FIG. 2, the flexible container is in a flattened, or in an otherwise evacuated state. The gusset panels 18, 20 fold inwardly (dotted gusset fold lines 60, 62 of FIGS. 1-2) and are sandwiched by the front panel 22 and the rear panel 24.

Figure 3:
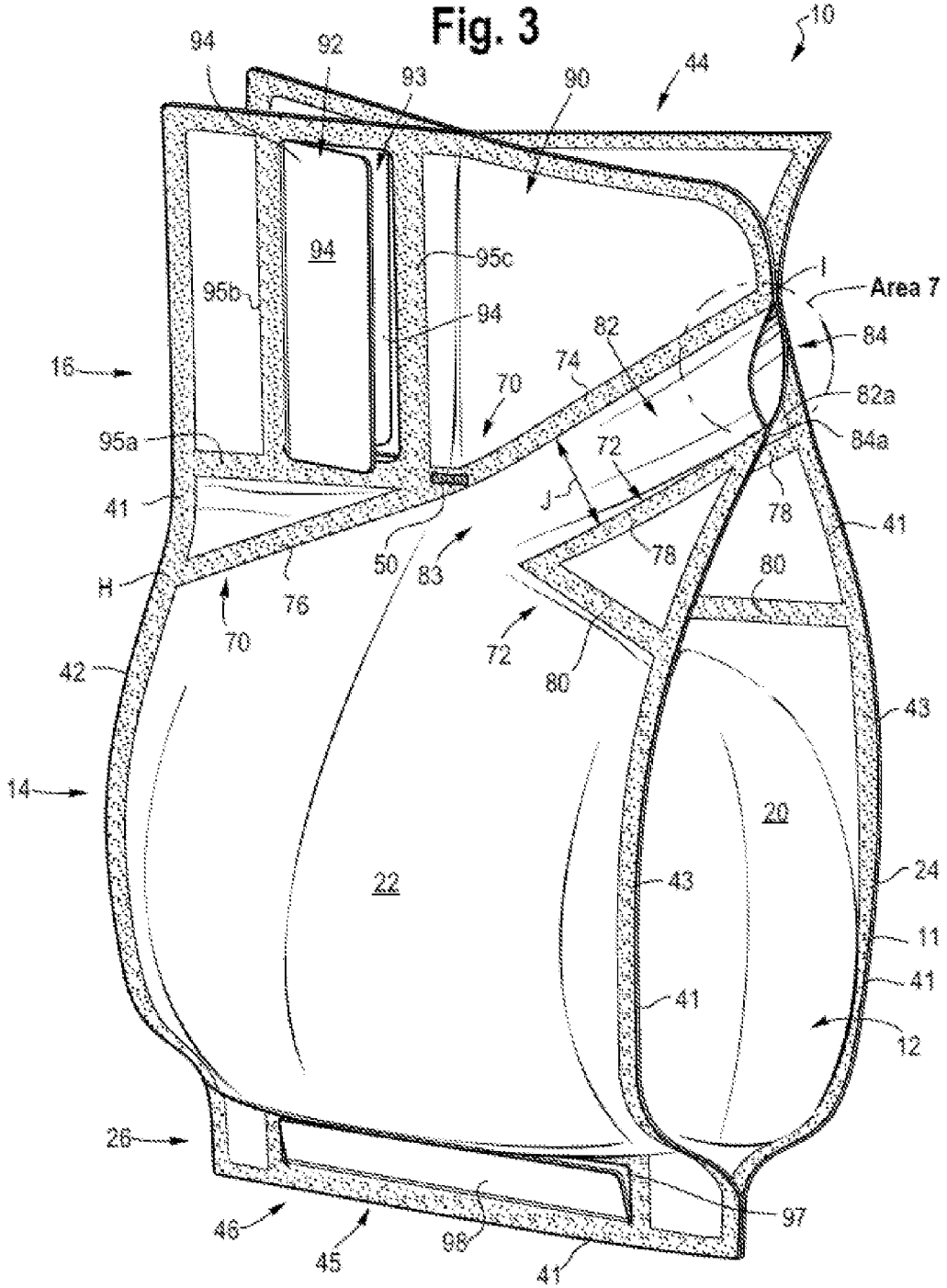
FIG. 3 is a perspective view of the flexible container of FIG. 2 in an expanded configuration, in accordance with an embodiment of the present disclosure.

The flexible container 10 has a collapsed configuration (as shown in FIG. 2) and has an expanded configuration (shown in FIG. 3). FIG. 2 shows the flexible container 10 having a bottom portion I, a body portion II, and a top portion III. In the expanded configuration, the bottom portion I forms a bottom section 26 (FIG. 3). The body portion II forms a body 14. The top portion III includes spout seals that form a sealed top for the chamber, the spout seals also forming a spout. The spout is in fluid communication with the chamber and extends to a seal segment as will be discussed below. Together sections I, II, and III form a closed chamber 12 (FIG. 3).

FIG. 3 shows flexible container 10 in the expanded configuration. The flexible container 10 has four panels, a first gusset panel 18, a second gusset panel 20, a front panel 22, and a rear panel 24. The four panels 18, 20, 22, and 24 form the body 14 (body portion II in collapsed configuration of FIG. 2), and top section 16 (that is top portion III in collapsed configuration of FIG. 2). The four panels 18, 20, 22, and 24 also form a bottom section 26 (bottom portion I in the collapsed configuration of FIG. 2).

B. Flexible Multilayer Film

Each panel 18, 20, 22, 24 is composed of a flexible multilayer film. In an embodiment, each panel 18, 20, 22, 24 is made from a flexible film having at least one, or at least two, or at least three layers. The flexible film is resilient, flexible, deformable, and pliable. The structure and composition of the flexible film for each panel 18, 20, 22, 24 may be the same or different. For example, each of the panels 18, 20, 22, 24 can be made from a separate web, each web having a unique structure and/or unique composition, finish, or print. Alternatively, each of the panels 18, 20, 22, 24 can be the same structure and the same composition.

The flexible multilayer film is composed of a polymeric material. Nonlimiting examples of suitable polymeric material include olefin-based polymer; propylene-based polymer; ethylene-based polymer; polyamide (such as nylon), ethylene-acrylic acid or ethylene-methacrylic acid and their ionomers with zinc, sodium, lithium, potassium, or magnesium salts; ethylene vinyl acetate (EVA) copolymers; and blends thereof. The flexible multilayer film can be either printable or compatible to receive a pressure sensitive label or other type of label for displaying of indicia on the flexible container 10.

In an embodiment, a flexible multilayer film is provided and includes at least three layers: (i) an outermost layer, (ii) one or more core layers, and (iii) an innermost seal layer. The outermost layer (i) and the innermost seal layer (iii) are surface layers with the one or more core layers (ii) sandwiched between the surface layers. The outermost layer may include (a-i) a HDPE, (b-ii) a propylene-based polymer, or combinations of (a-i) and (b-ii), alone, or with other olefin-based polymers such as LDPE. Nonlimiting examples of suitable propylene-based polymers include propylene homopolymer, random propylene/α-olefin copolymer (majority amount propylene with less than 10 weight percent ethylene comonomer), and propylene impact copolymer (heterophasic propylene/ethylene copolymer rubber phase dispersed in a matrix phase).

With the one or more core layers (ii), the number of total layers in the present multilayer film can be from three layers (one core layer), or four layers (two core layers), or five layers (three core layers, or six layers (four core layers), or seven layers (five core layers) to eight layers (six core layers), or nine layers (seven core layers), or ten layers (eight core layers), or eleven layers (nine core layers), or more.

The multilayer film has a thickness from 75 microns, or 100 microns, or 125 microns, or 150 microns to 200 microns, or 250 microns or 300 microns or 350 microns, or 400 microns.

The multilayer can be (i) coextuded, (ii) laminated, or (iii) a combination of (i) and (ii). In an embodiment, the multilayer film is a coextruded multilayer film.

In an embodiment, each panel 18, 20, 22, 24 is a flexible multilayer film having the same structure and the same composition.

In an embodiment, the flexible multilayer film has at least three layers: a seal layer, an outer layer, and a tie layer between. The tie layer adjoins the seal layer to the outer layer. The flexible multilayer film may include one or more optional inner layers disposed between the seal layer and the outer layer.

In an embodiment, the flexible multilayer film is a coextruded film having at least two, or three, or four, or five, or six, or seven to eight, or nine, or 10, or 11, or more layers. Some methods, for example, used to construct films are by cast co-extrusion or blown co-extrusion methods, adhesive lamination, extrusion lamination, thermal lamination, and coatings such as vapor deposition. Combinations of these methods are also possible. Film layers can comprise, in addition to the polymeric materials, additives such as stabilizers, slip additives, antiblocking additives, process aids, clarifiers, nucleators, pigments or colorants, fillers and reinforcing agents, and the like as commonly used in the packaging industry. It is particularly useful to choose additives and polymeric materials that have suitable organoleptic and or optical properties.

In an embodiment, the outermost layer includes a HDPE. In a further embodiment, the HDPE is a substantially linear multi-component ethylene-based copolymer (EPE) such as ELITE™ resin provided by The Dow Chemical Company.

In an embodiment, each core layer includes one or more linear or substantially linear ethylene-based polymers or ethylene/α-olefin multi-block copolymers having a density from 0.908 g/cc, or 0.912 g/cc, or 0.92 g/cc, or 0.921 g/cc to 0.925 g/cc, or less than 0.93 g/cc. In an embodiment, each of the one or more core layers includes one or more ethylene/$C_3$-$C_8$ α-olefin copolymers selected from linear low density polyethylene (LLDPE), ultralow density polyethylene (ULDPE), very low density polyethylene (VLDPE), EPE, olefin block copolymer (OBC), plastomers/elastomers, and single-site catalyzed linear low density polyethylenes (m-LLDPE).

In an embodiment, the seal layer includes one or more ethylene-based polymer having a density from 0.86 g/cc, or 0.87 g/cc, or 0.875 g/cc, or 0.88 g/cc, or 0.89 g/cc to 0.90 g/cc, or 0.902 g/cc, or 0.91 g/cc, or 0.92 g/cc. In an embodiment, the seal layer includes one or more ethylene/$C_3$-$C_8$ α-olefin copolymer selected from EPE, plastomers/elastomers, or m-LLDPE.

In an embodiment, the flexible multilayer film is a coextruded film, the seal layer is composed of an ethylene-based polymer, such as a linear or a substantially linear polymer, or a single-site catalyzed linear or substantially linear polymer of ethylene and an alpha-olefin monomer such as 1-butene, 1-hexene or 1-octene, having a Tm from 55° C. to 115° C. and a density from 0.865 to 0.925 g/cm$^3$, or from 0.875 to 0.910 g/cm$^3$, or from 0.888 to 0.900 g/cm$^3$ and the outer layer is composed of a polyamide having a Tm from 170° C. to 270° C.

In an embodiment, the flexible multilayer film is a coextruded and/or laminated film having at least five layers, the coextruded film having a seal layer composed of an ethylene-based polymer, such as a linear or substantially linear polymer, or a single-site catalyzed linear or substantially linear polymer of ethylene and an alpha-olefin comonomer such as 1-butene, 1-hexene or 1-octene, the ethylene-based polymer having a Tm from 55° C. to 115° C. and a density from 0.865 to 0.925 g/cm$^3$, or from 0.875 to 0.910 g/cm$^3$, or from 0.888 to 0.900 g/cm$^3$ and an outermost layer composed of a material selected from HDPE, EPE, LLDPE, OPET (biaxially oriented polyethylene terephthalate), OPP (oriented polypropylene), BOPP (biaxially oriented polypropylene), polyamide, and combinations thereof.

In an embodiment, the flexible multilayer film is a coextruded and/or laminated film having at least seven layers. The seal layer is composed of an ethylene-based polymer, such as a linear or substantially linear polymer, or a single-site catalyzed linear or substantially linear polymer of ethylene and an alpha-olefin comonomer such as 1-butene, 1-hexene or 1-octene, the ethylene-based polymer having a Tm from 55° C. to 115° C. and density from 0.865 to 0.925 g/cm$^3$, or from 0.875 to 0.910 g/cm$^3$, or from 0.888 to 0.900 g/cm$^3$. The outer layer is composed of a material selected from HDPE, EPE, LLDPE, OPET, OPP, BOPP, polyamide, and combinations thereof.

In an embodiment, the flexible multilayer film is a coextruded (or laminated) film of three or more layers where all layers consist of ethylene-based polymers. In a further embodiment, the flexible multilayer film is a coextruded (or laminated) film of three or more layers where each layer consists of ethylene-based polymers and (1) the seal layer is composed of a linear or substantially linear ethylene-based polymer, or a single-site catalyzed linear or substantially linear polymer of ethylene and an alpha-olefin comonomer such as 1-butene, 1-hexene or 1-octene, the ethylene-based polymer having a Tm from 55° C. to 115° C. and density from 0.865 to 0.925 g/cm$^3$, or from 0.875 to 0.910 g/cm$^3$, or from 0.888 to 0.900 g/cm$^3$ and (2) the outer layer includes one or more ethylene-based polymers selected from HDPE, EPE, LLDPE or m-LLDPE and (3) each of the one or more core layers includes one or more ethylene/$C_3$-$C_8$ α-olefin copolymers selected from low density polyethylene (LDPE), linear low density polyethylene (LLDPE), ultralow density polyethylene (ULDPE), very low density polyethylene (VLDPE), EPE, olefin block copolymer (OBC), plastomers/elastomers, and single-site catalyzed linear low density polyethylenes (m-LLDPE).

In an embodiment, the flexible multilayer film is a coextruded and/or laminated five layer, or a coextruded (or laminated) seven layer film having at least one layer containing OPET or OPP.

In an embodiment, the flexible multilayer film is a coextruded (or laminated) five layer, or a coextruded (or laminated) seven layer film having at least one layer containing polyamide.

In an embodiment, the flexible multilayer film is a seven-layer coextruded (or laminated) film with a seal layer composed of an ethylene-based polymer, or a linear or substantially linear polymer, or a single-site catalyzed linear or substantially linear polymer of ethylene and an alpha-olefin monomer such as 1-butene, 1-hexene or 1-octene, having a Tm from 90° C. to 106° C. The outer layer is a polyamide having a Tm from 170° C. to 270° C. The film has an inner layer (first inner layer) composed of a second ethylene-based polymer, different than the ethylene-based polymer in the seal layer. The film has an inner layer (second inner layer) composed of a polyamide the same or different to the polyamide in the outer layer. The seven layer film has a thickness from 100 micrometers to 250 micrometers.

Figure 4:
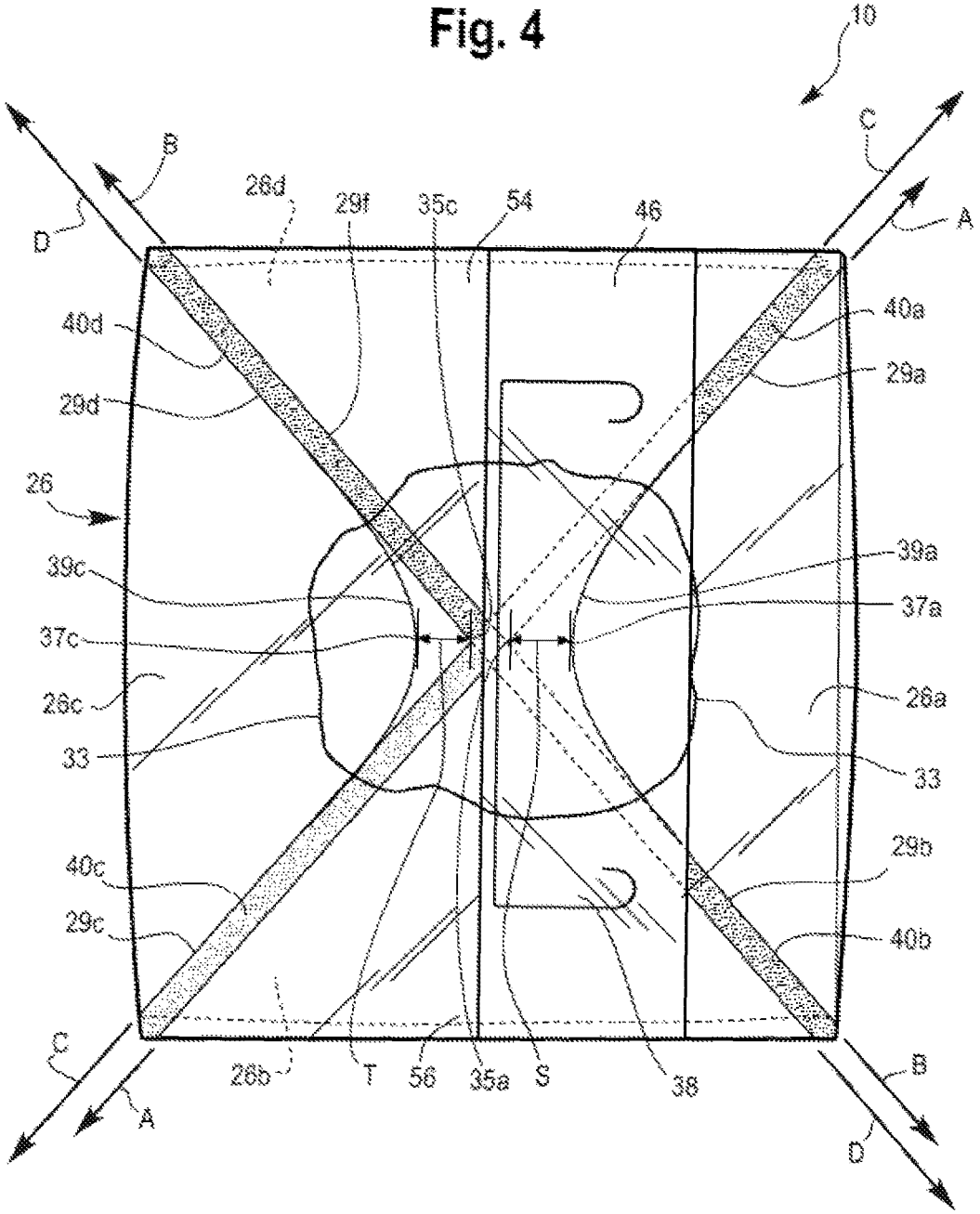
FIG. 4 is a bottom plan view of the expanded flexible container of FIG. 3, in accordance with an embodiment of the present disclosure.

In an embodiment, four webs of flexible multilayer film material are provided, one web of film for each respective panel 18, 20, 22, and 24, each multilayer film having the same composition and structure. FIGS. 1-2 show the films superimposed on each other in a "gusset sandwich" configuration such that the four films form a common periphery 11. Each film is sealed to the adjacent web of film to form a common peripheral seal 41 shown in FIGS. 2-3. The peripheral tapered seals 40*a*-40*d* are located on the bottom segment 26 of the container as shown in FIG. 4. The common peripheral seal 41 is located along the common periphery 11.

FIG. 2 shows the common peripheral seal 41 is composed of four seals. The individual seals of the peripheral seal 41 include a first side segment 42 and an opposing second side segment 43, a top segment 44 and an opposing bottom segment 45. The common peripheral seal 41 (composed of the seals 42, 43, 44, 45) form the chamber 12.

C. Bottom Section

The flexible container 10 includes bottom section 26. Each panel 18, 20, 22, 24 has a respective bottom face that is present in the bottom section 26. The four bottom faces are sealed together to define the bottom section 26. FIG. 4 shows four triangle-shaped bottom faces 26*a*, 26*b*, 26*c*,-26*d*, each bottom face being an extension of a respective film panel. The bottom faces 26*a*-26*d* make up the bottom section 26. The four panels 26*a*-26*d* come together at a midpoint of the bottom section 26. The bottom faces 26*a*-26*d* are sealed together, such as by using a heat-sealing technology, to form the bottom handle 46. For instance, a weld can be made to form the bottom handle 46, and to seal the edges of the bottom section 26 together. Nonlimiting examples of suitable heat-sealing technologies include hot bar sealing, hot die sealing, impulse sealing, high frequency sealing, or ultrasonic sealing methods.

Figure 5:
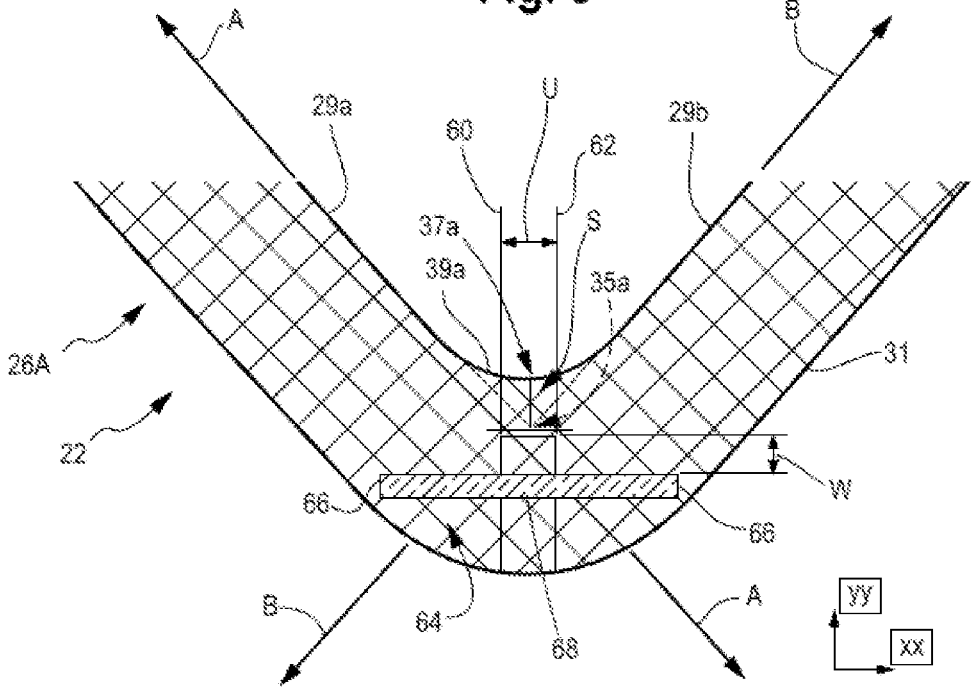
FIG. 5 is an enlarged view of Area 5 of FIG. 2.

FIG. 4 shows that each bottom face 26*a*-26*d* is bordered by two opposing peripheral tapered seals 40*a*-40*d*. Each peripheral tapered seal 40*a*-40*d* extends from a respective peripheral seal 41 in the body 14, shown in FIGS. 2-3. FIGS. 4-5 show the peripheral tapered seals for the front panel 22 and the rear panel 24 have an inner edge 29*a*-29*d* and an outer edge 31. The peripheral tapered seals 40*a*-40*d* converge at a bottom seal area 33.

The front panel bottom face 26*a* includes a first line A defined by the inner edge 29*a* of the first peripheral tapered seal 40*a* and a second line B defined by the inner edge 29*b* of the second peripheral tapered seal 40*b*. The first line A intersects the second line B at an apex point 35*a* in the bottom seal area 33. The front panel bottom face 26*a* has a bottom distalmost inner seal point 37*a* ("BDISP 37*a*"). The BDISP 37*a* is located on the inner edge.

The apex point 35*a* is separated from the BDISP 37*a* by a distance S from 0 millimeter (mm) to less than 8.0 mm.

In an embodiment, the rear panel bottom face 26*c* includes an apex point similar to the apex point on the front panel bottom face. The rear panel bottom face 26*c* includes a first line C defined by the inner edge of the 29*c* first peripheral tapered seal 40*c* and a second line D defined by the inner edge 29*d* of the second peripheral tapered seal 40*d*. The first line C intersects the second line D at an apex point 35*c* in the bottom seal area 33. The rear panel bottom face 26*c* has a bottom distalmost inner seal point 37*c* ("BDISP 37*c*"). The BDISP 37*c* is located on the inner edge. The apex point 35*c* is separated from the BDISP 37*c* by a distance T from 0 millimeter (mm) to less than 8.0 mm.

It is understood the following description to the front panel bottom face applies equally to the rear panel bottom face, with reference numerals to the rear panel bottom face shown in adjacent closed parentheses.

In an embodiment, the BDISP 37*a* (37*c*) is located where the inner edges 29*a* (29*c*) and 29*b* (29*d*) intersect. The distance between the BDISP 37*a* (37*c*) and the apex point 35*a* (35*c*) is 0 mm.

In an embodiment, the inner seal edge diverges from the inner edges 29*a*, 29*b* (29*c*, 29*d*), to form an inner seal arc 39*a* (front panel) and inner seal arc 39*c* (rear panel) as shown in FIGS. 4 and 5. The BDISP 37*a* (37*c*) is located on the inner seal arc 39*a* (39*c*). The apex point 35*a* (apex point 35*c*) is separated from the BDISP 37*a* (BDISP 37*c*) by the distance S (distance T) which is from greater than 0 mm, or 1.0 mm, or 2.0 mm, or 2.6 mm, or 3.0 mm, or 3.5 mm, or 3.9 mm to 4.0 mm, or 4.5 mm, or 5.0 mm, or 5.2 mm, or 5.3 mm, or 5.5 mm, or 6.0 mm, or 6.5 mm, or 7.0 mm, or 7.5 mm, or 7.9 mm.

In an embodiment, apex point 35*a* (35*c*) is separated from the BDISP 37*a* (37*c*) by the distance S (distance T) which is from greater than 0 mm to less than 6.0 mm.

In an embodiment, the distance from S (distance T) from the apex point 35*a* (35*c*) to the BDISP 37*a* (37*c*) is from greater than 0 mm, or 0.5 mm or 1.0 mm, or 2.0 mm to 4.0 mm or 5.0 mm or less than 5.5 mm.

In an embodiment, apex point 35*a* (apex point 35*c*) is separated from the BDISP 37*a* (BDISP 37*c*) by the distance S (distance T) which is from 3.0 mm, or 3.5 mm, or 3.9 mm to 4.0 mm, or 4.5 mm, or 5.0 mm, or 5.2 mm, or 5.3 mm, or 5.5 mm.

In an embodiment, the distal inner seal arc 39*a* (39*c*) has a radius of curvature from 0 mm, or greater than 0 mm, or 1.0 mm to 19.0 mm, or 20.0 mm.

In an embodiment, each peripheral tapered seal 40*a*-40*d* (outside edge) and an extended line from respective peripheral seal 41 (outside edge) form an angle G as shown in FIG. 2. The angle G is from 40°, or 42°, or 44°, or 45° to 46°, or 48, or 50°. In an embodiment, angle G is 45°.

In FIG. 4, the bottom section 26 includes a pair of gussets 54 and 56 formed thereat, which are essentially extensions of the bottom faces 26*a*-26*d*. The gussets 54 and 56 can facilitate the ability of the flexible container 10 to stand upright. These gussets 54 and 56 are formed from excess material from each bottom face 26*a*-26*d* that are joined together to form the gussets 54 and 56. The triangular portions of the gussets 54 and 56 comprise two adjacent bottom segment panels sealed together and extending into its respective gusset. For example, adjacent bottom faces 26*a* and 26*d* extend beyond the plane of their bottom surface along an intersecting edge and are sealed together to form one side of a first gusset 54. Similarly, adjacent bottom faces 26*c* and 26*d* extend beyond the plane of their bottom surface along an intersecting edge and are sealed together to form the other side of the first gusset 54. Likewise, a second gusset 56 is similarly formed from adjacent bottom faces 26*a*-26*b* and 26*b*-26*c*. The gussets 54 and 56 can contact a portion of the bottom section 26, where the gusset portions gussets 54 and 56 can contact bottom faces 26*b* and 26*d* covering them, while bottom segment panels 26*a* and 26*c* remain exposed at the bottom end 46.

As shown in FIG. 4, the gussets 54 and 56 of the flexible container 10 can further extend into the bottom handle 46. In the aspect where the gussets 54 and 56 are positioned adjacent bottom section panels 26*b* and 26*d*, the bottom handle 46 can also extend across bottom faces 26*b* and 26*d*, extending between the pair of panels 18 and 20. The bottom handle 46 can be positioned along a center portion or midpoint of the bottom section 26 between the front panel 22 and the rear panel 24.

FIG. 5 shows an enlarged view of the bottom seal area 33 (area 5) of FIG. 2 and the front panel 26*a*. The fold lines 60 and 62 of respective gusset panels 18, 20 are separated by a distance U that is from 0 mm, or greater than 0 mm, or 0.5 mm, or 1.0 mm, or 2.0 mm, or 3.0 mm, or 4.0 mm, or 5.0 mm to 12.0 mm, or greater than 60.0 mm (for larger containers, for example). In an embodiment, distance U is from greater than 0 mm to less than 6.0 mm. FIG. 5 shows line A (defined by inner edge 29*a*) intersecting line B (defined by inner edge 29*b*) at apex point 35*a*. BDISP 37*a* is on the distal inner seal arc 39*a*. Apex point 35*a* is separated from BDISP 37*a* by S having a length from greater than 0 mm or 1.0 mm, or 2.0 mm, or 2.6 mm, or 3.0 mm, or 3.5 mm, or 3.9 mm to 4.0 mm, or 4.5 mm, or 5.0 mm, or 5.2 mm, or 5.5 mm, or 6.0 mm, or 6.5 mm, or 7.0 mm, or 7.5 mm, or 7.9 mm.

In FIG. 5, an overseal 64 is formed where the four peripheral tapered seals 40*a*-40*d* (of FIG. 4) converge in the bottom seal area. The overseal 64 includes 4-ply portions 66, where a portion of each panel is heat sealed to a portion of every other panel. Each panel represents 1-ply in the 4-ply heat seal. The overseal 64 also includes a 2-ply portion 68 where two panels (front panel and rear panel) are sealed together. Consequently, the "overseal," as used herein, is the area where the peripheral tapered seals converge that is subjected to a subsequent heat seal operation (and subjected to at least two heat seal operations altogether). The overseal is located in the peripheral tapered seals and does not extend into the chamber of the flexible container 10.

In an embodiment, the apex point 35*a* is located above the overseal 64. The apex point 35*a* is separated from, and does not contact the overseal 64. The BDISP 37*a* is located above the overseal 64. The BDISP 37*a* is separated from and does not contact the overseal 64.

In an embodiment, the apex point 35*a* is located between the BDISP 37*a* and the overseal 64, wherein the overseal 64 does not contact the apex point 35*a* and the overseal 64 does not contact the BDISP 37*a*.

Figure 6:
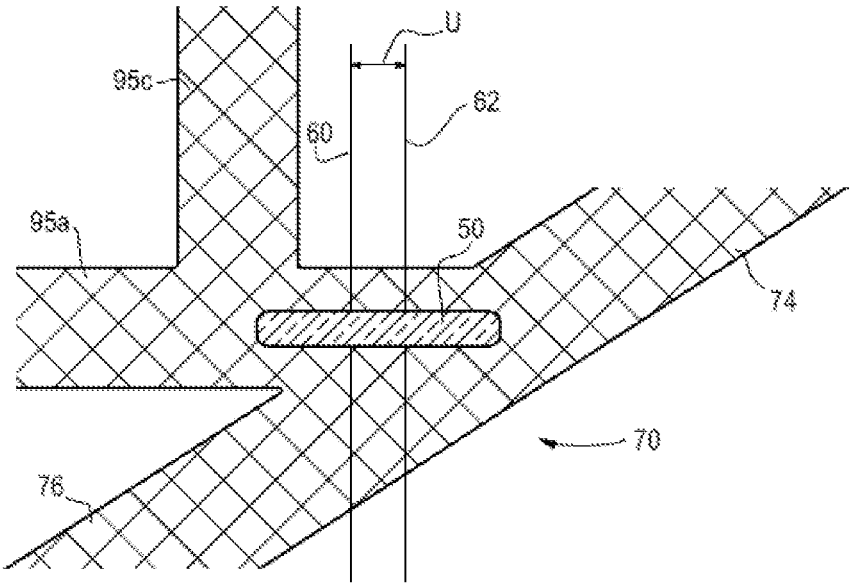
FIG. 6 is an enlarged view of Area 6 of FIG. 2.

The distance between the apex point 35*a* to the top edge of the overseal 64 is defined as distance W shown in FIG. 6. In an embodiment, the distance W has a length from 0 mm, or greater than 0 mm, or 2.0 mm, or 4.0 mm to 6.0 mm, or 8.0 mm, or 10.0 mm or 15.0 mm.

When more than four webs are used to produce the container, the portion 68 of the overseal 64 may be a 4-ply, or a 6-ply, or an 8-ply portion.

D. Spout Seals

FIGS. 2-3 show the flexible container 10 has an upper spout seal 70 and a lower spout seal 72. The upper spout seal 70 extends from point H, the intersect point between the first side seal 42 and the upper spout seal 70, to point I, the intersect point between the upper spout seal 70 and the second side seal 43. Point I is higher (or is above) than point H, when the bottom section 26 is the reference point. At point I, the second side seal 43 is configured to be an openable seal as will be discussed below.

The upper spout seal 70 and the lower spout seal 72 are configured to simultaneously (i) form the top geometry for the chamber 12 and (ii) also form a spout. Each spout seal 70, 72 has two respective segments, a spout seal segment and a chamber seal segment. The upper spout seal 70 has a upper spout seal segment 74 (or u-SSS 74) and a first chamber seal segment 76 (or 1-CSS 76). The lower spout seal 72 has a lower spout seal segment 78 (or l-SSS 78) and a second chamber seal segment 80 (or 2-CSS 80).

The 1-CSS 76 (a component of the upper spout seal 70) and the 2-CSS 80 (a component of the lower spout seal 72), seal the top of the chamber 12. FIGS. 2-3 show that the 1-CSS and 2-CSS 76, 80 each as an end that begins at the body 14, intersecting peripheral seal 41. Each 1-CSS and 2-CSS 76, 80 tapers upwardly and inwardly from a respective side seals 42, 43 to close the interior volume created by the peripheral seal 41. The 1-CSS and 2-CSS 76, 80 in conjunction with each other define the top of the chamber 12 and close the chamber 12. The 1-CSS and 2-CSS 76, 80 are tapered to give the chamber 12 a "peaked rooftop" geometry. With this peak roof-top geometry for the closed top of the chamber 12, the chamber seal segments 76, 80 provide the flexible container 10 vertical and upper stability when the chamber 12 is filled with an amount of material (such as an amount of bulk material, for example), thereby reducing the risk of spillage and/or tipping.

In an embodiment, 1-CSS and 2-CSS each form an upper chamber angle with a respective side seal. As shown in FIG. 2, 1-CSS 76 forms a first upper chamber angle N with the first side seal 42. 2-CSS 80 forms a second upper chamber angle O with second side seal 43. The magnitude of the first and second upper chamber angles N, O may be the same or different. In an embodiment, the magnitude for the first upper chamber and the second upper chamber angles is the same and the angles N, O each have a magnitude from 110°, or 120°, or 130° to 140° or 150°. In a further embodiment, angle N and angle O each is 135°.

The upper spout seal 70 and the lower spout seal 72 are spatially arranged to create a spout in the flexible container 10. The l-SSS 78 is reciprocally aligned with the u-SSS 74 to form a spout. The term "reciprocally aligned" refers to the spatial orientation of the spout seal segments with respect to each other whereby the lower spout seal segment is spaced away from, and also extends along with, the upper spout seal segment to form a fluid channel which extends between the chamber and one of the side seals of the peripheral seal 41.

Although FIG. 2 shows the spout 82 as a straight, or a substantially straight channel, it is understood that the spout may be curved. For example u-SSS 74 could curve upward with respect to 1-CSS 76, with l-SSS 78 also having a curved shape to be reciprocally aligned with u-SSS 74.

FIGS. 2-3 show lower spout seal segment 78 spaced away a separation distance J from upper spout seal segment 74 to create a spout 82. The spout 82 has a proximate end 83 that is in fluid communication with the chamber 12, the spout being a channel through which a flowable material can pass from the chamber 12 for discharge from the container 10. The spout 82 has a distal end 84 located at second side seal 43. The separation distance J between upper spout seal segment 74 and the lower spout seal segment 78 may be constant along the length of the spout seal segments whereby lower spout seal segment 78 may be parallel to, or be substantially parallel to, upper spout seal segment 74. Alternatively, the separation distance J between the upper spout seal segment 74 and the lower spout seal segment 78 may change along the spout length. The separation distance may decrease from the chamber to the spout outlet 84 whereby the upper and lower spout seal segments 74, 78 form a narrow outlet, for a nozzle-type discharge of the chamber content from the flexible container 10.

In an embodiment, the flexible container 10 includes an upper overseal 50. The upper overseal 50 is located in the top portion III (FIG. 2) of the flexible container 10. The upper overseal 50 defines a center point for the upper spout seal 70, with the first chamber seal segment 76 on one side of the upper overseal 50 and the upper spout seal segment 74 on the other side of the upper overseal 50. The upper overseal 50 includes 4-ply portions, where a portion of each panel is heat sealed to a portion of every other panel. Each panel represents 1-ply in the 4-ply heat seal. The upper overseal 50 also includes a 2-ply portion, where two panels (front panel and rear panel) are sealed together. The 2-ply portion is seen in FIG. 6 as the gap U between gusset folds 60, 62. The upper overseal 50 provides reinforcement and added strength to the top section 16 (FIG. 3). The top section 16 is subject to torque and other pulling forces when a person handles the flexible container to pour content from the chamber and through the spout. The upper overseal 50 reduces, or eliminates, leakage from the flexible container 10.

E. Access Member

Figure 7:
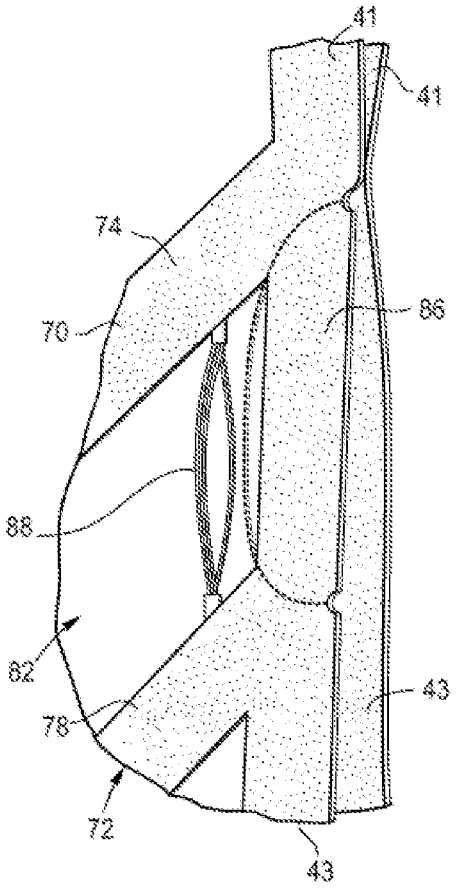
FIG. 7 is an enlarged perspective view of Area 7 of FIG. 3, FIG. 7 showing an access member at the distal end of the spout, in accordance with an embodiment of the present disclosure.
Figure 8:
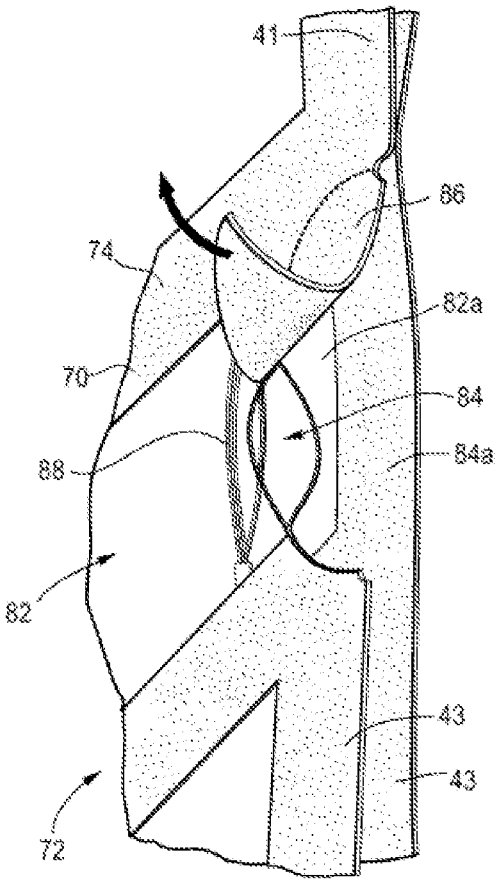
FIG. 8 is a perspective view showing the activation of the access member of FIG. 7, in accordance with an embodiment of the present disclosure.

FIG. 7 shows a pre-use configuration of flexible container 10, whereby the distal end 84 is sealed closed at the second side seal 43. In an embodiment, the distal end 84 includes an access member. An "access member" is a structure that enables access to, or the opening of, the distal end 84 of spout 82. By actuating access to the spout, the access member thereby enables access to the contents of the chamber 12. In FIGS. 7-8, the enlarged perspective views of Area 7 (of FIG. 3) show an access member 86 that extends across the separation distance of the spout distal end 84, the spout distal end located at the second side seal 43. Actuation of the access member 86 opens the distal end 84 of the spout and enables access to the contents stored in the chamber 12. The term "actuate," "actuated," and like terms is the act of manipulating the access member to open the spout 82, enabling ingress and egress to and from chamber 12. Actuation includes such nonlimiting acts as pulling, tearing, peeling, separating, folding (and any combination thereof), the access member 86 to open the spout distal end 84. Nonlimiting examples of suitable access members include a tear notch, a tear slit, a perforation, a line of weakness, a cut line, and combinations thereof.

FIG. 7 shows an embodiment wherein the access member 86 is a perforation. Actuation of the perforation, namely, a pulling force across the perforation opens the distal end 84 and exposes the open spout 82. Although FIG. 7 shows the access member 86 as a perforation, it is understood that the access member could be a tear notch, a tear slit, a line of weakness, a cut line, and combinations thereof, alone, or in combination, with the perforation.

In an embodiment, FIGS. 7-8 show the flexible container 10 with an accessory structure located upstream of the access member. Nonlimiting examples of suitable accessory structure include a re-seal structure such as a pressure seal, a pressure zipper, and/or a slide zipper; a clamp, a clip; a microcapillary strip; and any combination thereof.

In an embodiment, the flexible container 10 includes a re-seal structure that is a pressure zipper 88 as shown in FIGS. 7-8.

In the container fabrication process, two opposing heat seal plates in conjunction with the one-up layer configuration of the four panels (the two gusset 18, 20 panels sandwiched between the front and rear panels 22,24) produce spout 82 that is formed by two panels, namely the front panel 22 and the second gusset panel 20. The fabrication process also produces a second spout 82*a* that is directly behind the spout 82 (when viewing the collapsed flexible container 10 from front elevation view). FIG. 3 shows a portion of the second spout 82*a*. The second spout 82*a* is formed from the second gusset panel 20 and the rear panel 24. The second spout 82*a* includes a spout seal segment and chamber seal segment, similar to spout 82. The second spout 82*a* also includes a distal end 84*a* (FIGS. 3, 8).

The second spout 82*a* may be an operational spout or may be a dormant spout. In an embodiment, the spout 82*a* is an operational spout and includes an access member for actuating the second spout 82*a*. The access member may be any structure as described with respect to the access member for spout 82. In this embodiment, the flexible container 10 has two spouts (82, 82*a*) for rapid evacuation of the container contents.

In an embodiment, the second spout 82*a* is a dormant spout whereby the seal at the distal end 84*a* of the spout 82*a* is a permanent seal and lacks an access member. In this embodiment, the spout 82 is the sole operational spout. The permanent seal at the distal end 84*a* prevents content discharge from the spout 82*a*. FIGS. 3 and 8 show the second spout 82*a* as a dormant spout. The distal seal 84*a* is a permanent seal, so that the second spout 82*a* cannot be opened.

In an embodiment, a flowable material (i.e., product) is loaded into the flexible container 10 through the dormant spout 82*a*. Permanent seal 84*a* is formed after product load. Alternatively, product is loaded through the active spout 82 prior to formation of the access member 86.

When second spout 82*a* is a dormant spout, a heat seal can be formed upstream of the distal end 84*a*, near the chamber 12 in order to keep product out of the second (dormant) spout 82*a*.

In an embodiment, spout 82 and second spout 82*a* are adhered together, or otherwise tacked together, such that the spout 82 and the second spout 82*a* are directly adjacent to, or otherwise in direct contact with, each other. A heat seal and/or an adhesive material can be used to tack, or otherwise place, spout 82 and dormant spout 82 in direct contact with each other.

F. Handle

In an embodiment, the flexible container 10 includes a land of panel material 90 (hereafter referred to as "land 90"). The land 90 is a polygonal area in the top portion III (FIG. 2). The land 90 includes portions of each panel 18-24 and is bounded by the upper spout seal 70 (on the bottom), first side seal 42, top seal 44, and the second side seal 43.

In an embodiment, the flexible container 10 includes a top handle 92 located in the land 90. The handle 92 includes a cut-out section 93 (FIG. 3), defining a handle opening. FIG. 3 shows that the cut-out section 93 forms a flap 94 that is cut out along three sides while the flap 94 remains attached to the land 90 at a fourth side. The flap 94 of panel material can be pushed through the handle opening by the user and folded over to provide a relatively smooth gripping surface at an edge that contacts the user's hand. The land 90 may include optional seals 95*a*, 95*b*, 95*c*. The seals 95*a*-95*c* circumscribe the cut-out section 93 and provide additional strength and reinforcement to the cut-out section 93. Alternatively, the flap 94 may be removed from the flexible container 10. Handles in land 90 may be tacked together for consumer comfort and convenience.

In an embodiment, the flexible container 10 includes a bottom handle 46. The bottom handle 46 is located in the bottom portion I. The bottom handle 46 includes a cut-out section 97 (FIG. 3), defining a handle opening. FIG. 3 shows that the cut-out section 97 forms a flap 98 that is cut out along three sides while the flap 98 remains attached to the bottom portion I at a fourth side. The flap of panel material 98 can be pushed through the handle opening by the user and folded over to provide a relatively smooth gripping surface at an edge that contacts the user's hand. The bottom portion I may include optional seals 99*a*, 99*b* (FIG. 2). The seals 99*a*-99*b* provide additional strength and reinforcement to the bottom handle opening. Alternatively, the flap 98 may be removed from the flexible container 10.

Although FIGS. 2 and 3 show the flexible container 10 with two handles (top handle 92 and bottom handle 46), it is understood that the flexible container 10 can have one or both of handles 92 and/or 46. Furthermore, although FIGS. 2 and 3 show handles 92 and 46 having a rectangular shape, it is understood that handles 92, 46 can have other shapes.

In an embodiment, a grip member can be attached to either the top handle 92 or the bottom handle 46. The grip member can be placed around top handle 92 and/or bottom handle 14. Grip member can also be molded into the flexible container. The grip member can be adhesively attached to any portion of the flexible container. The grip member provides additional comfort to the user when carrying, or otherwise using, the flexible container. The grip member provides additional reinforcement to the flexible container. In a further embodiment, the grip member can be removed from the flexible container 10 after use and be re-used with another flexible container.

When the container 10 is in a rest position, such as when it is standing upright on its bottom section 26, as shown in FIG. 3, the bottom handle 46 can be folded underneath the container 10 so that it is parallel to the bottom segment 26 and adjacent bottom panel 26*a*. The flexible container 10 can stand upright even with the bottom handle 96 positioned underneath the upright container 10.

Figure 9:
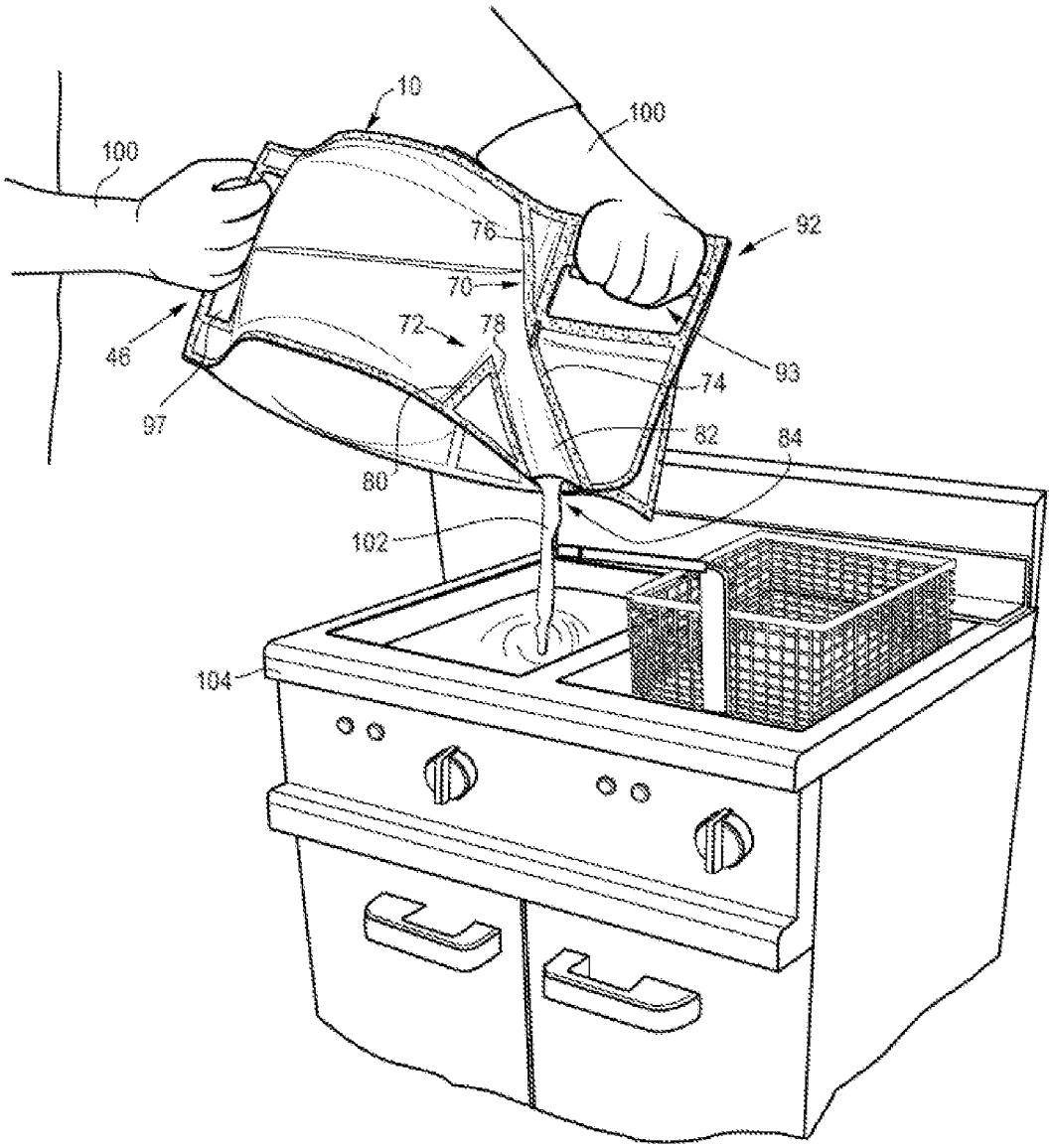
FIG. 9 is a perspective view of a person pouring contents from the flexible container of FIG. 3, in accordance with an embodiment of the present disclosure.

FIG. 9 shows a person 100 using handles 92, 46 to discharge the contents of the flexible container 10. The handles 92, 46 provide the person with stability, convenience, and comfort when discharging the contents of the chamber 12. The seal geometry, and the spout construction make flexible container 10 advantageous for the storage, transport, and delivery of bulk materials. FIG. 9 shows a nonlimiting example whereby a bulk amount of cooking oil 102 contained in the flexible container 10 is poured into a food fryer 104.

2. Flexible Container with Top Spout

The present disclosure provides another flexible container. In an embodiment, the flexible container includes (A) four panels adjoined along a common peripheral seal. The common peripheral seal includes a first side seal, an opposing second side seal, a top seal and an opposing bottom seal. The four seals form a chamber. (B) Each panel includes a bottom face. The four bottom faces are sealed together to define a bottom section. (C) An upper spout seal extends from the first side seal to the top seal. The flexible container includes (D) a lower spout seal. (E) The upper spout seal and the lower spout seal each comprise a respective spout seal segment and a respective chamber seal segment. (F) The chamber seal segments define a sealed chamber top. (G) The lower spout seal segment is reciprocally aligned with the upper spout seal segment to form a spout. The spout extends from the sealed chamber top to the top seal.

Figure 10:
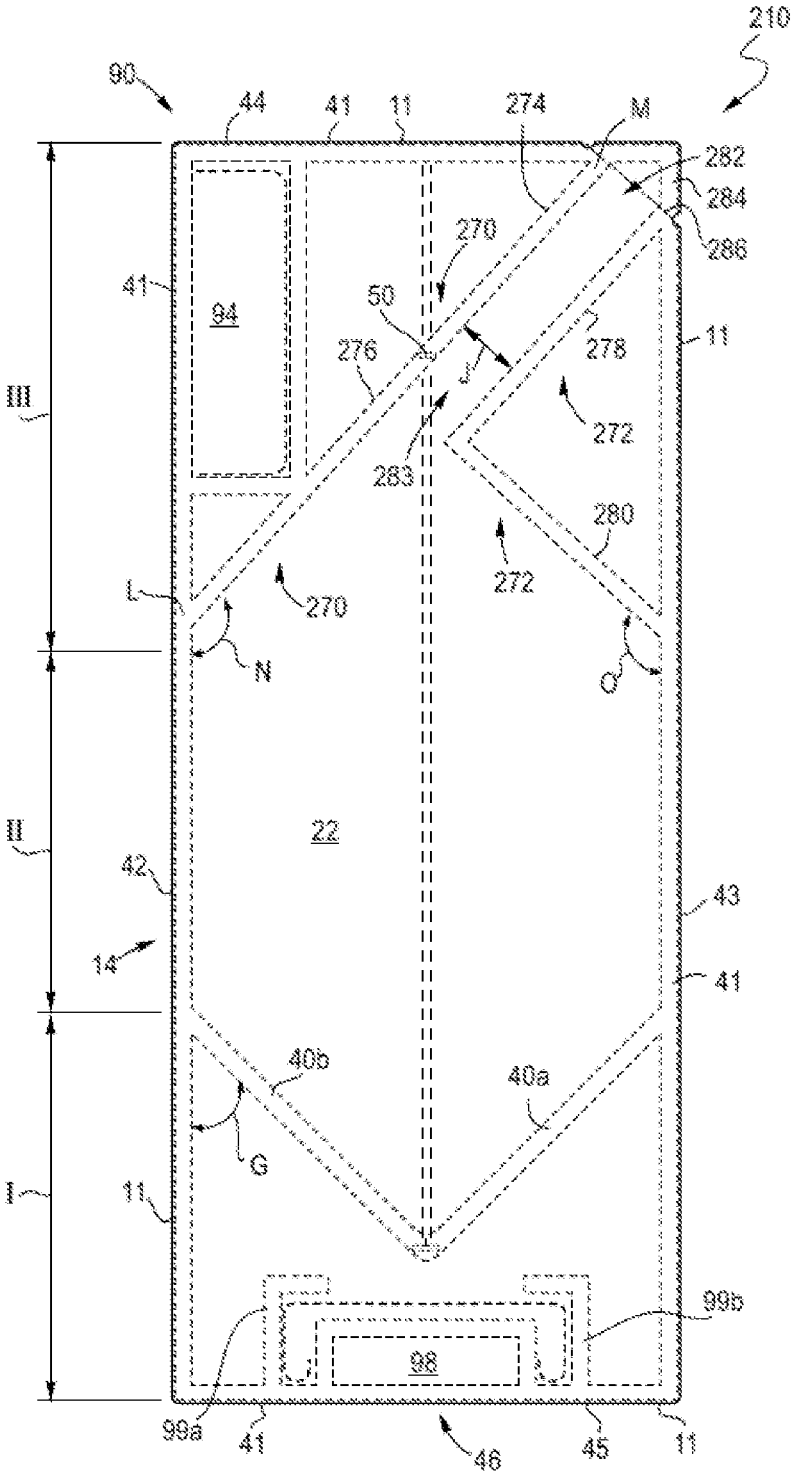
FIG. 10 is a front elevational view of another flexible container in a collapsed configuration in accordance with an embodiment of the present disclosure.
Figure 11:
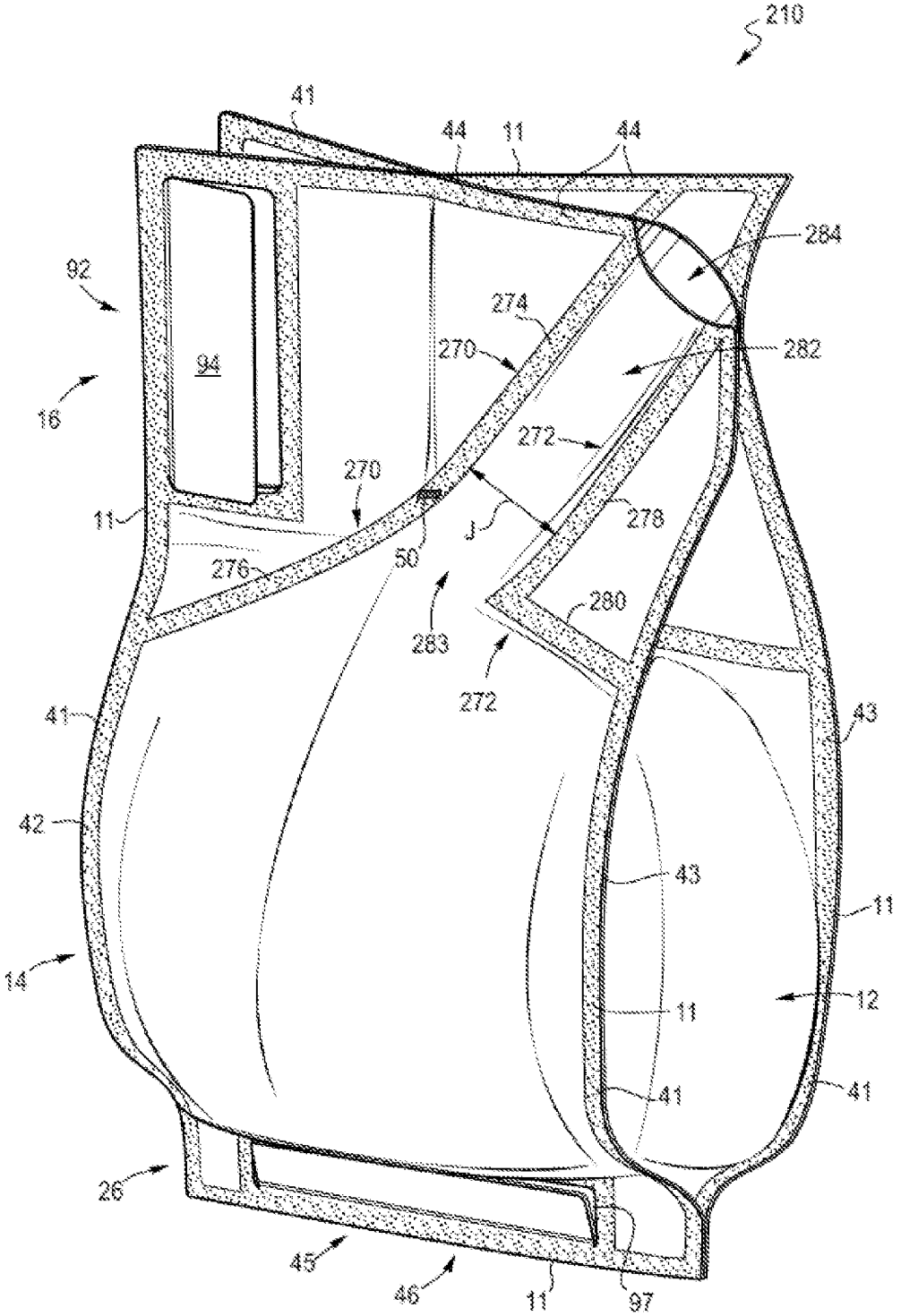
FIG. 11 is a perspective view of the flexible container of FIG. 10 in an expanded configuration, in accordance with an embodiment of the present disclosure.

FIGS. 10-11 show a flexible container 210. Flexible container 210 is the same as, or is substantially the same as, flexible container 10, with the difference being the configuration for the upper spout seal and the lower spout seal. Flexible container 10 embodies a side spout (i.e., spout 82), whereas the flexible container 210 embodies a top spout as described below.

FIGS. 10-11 show flexible container 210 having an upper spout seal 270 and a lower spout seal 272. The upper spout seal 270 extends from point L, the intersect point between the first side seal 42 and the upper spout seal 270, to point M, the intersect point between the upper spout seal 270 and the top seal 44, where point M is near the second side seal 43. FIGS. 10-11 show point M is higher (or is above) point L, when the bottom section 26 (FIG. 11) is the reference point. Point M is located on top seal 44.

The upper spout seal 270 and the lower spout seal 272 are configured to simultaneously (i) form the top geometry for the chamber 12 and (ii) also form a spout. Each spout seal 270, 272 has two respective seal segments, a spout seal segment and a chamber seal segment. The upper spout 270 has an upper spout seal segment 274 (or u-SSS 274) and a first chamber seal segment 276 (or 1-CSS 276). The lower spout seal has a lower spout seal segment 278 (or l-SSS 278) and a second chamber seal segment 280 (or a 2-CSS 280).

The 1-CSS 276 (a component of the upper spout seal 270) and the 2-CSS segment 280 (a component of the lower spout seal 272), seal the top of the chamber 12. FIGS. 10-11 show that the 1-CSS and 2-CSS 276, 280 each as an end that begins at body portion II, intersecting peripheral seal 41. Each 1-CSS and 2-CSS, 276, 280 tapers upwardly and inwardly from a respective side seal 42, 43 to close the interior volume and form chamber 12. The 1-CSS and 2-CSS 276, 280 in conjunction with each other define the top of the chamber 12 and close the chamber 12. The 1-CSS and 2-CSS 276, 280 are tapered to give the chamber 12 a "peaked rooftop" geometry as previously disclosed.

The lower spout seal segment 278 is reciprocally aligned with the upper spout seal segment 274 to form a spout 282. FIGS. 10-11 show lower spout seal segment 278 spaced away a separation distance J from upper spout seal segment 274 to create a spout 282. The length of the separation distance J may be uniform, or may vary, as previously disclosed. The spout 282 has a proximate end 283 that is in fluid communication with the chamber 12, the spout being a channel through which a flowable material can pass from the chamber 12 for discharge from the container 210. The spout 282 has a distal end 284 located at the top seal 44. In an embodiment, the distal end 284 can be configured to form a top corner spout 284 as shown in FIGS. 10-11. At the distal end 284, the spout opening extends diagonally downward from the top seal 44 to the second side seal 43. The distal end 284 includes an access member, tear seal 286, for opening the distal end 284 of the spout 282.

In an embodiment, the present flexible container 10, 210 is void of a rigid spout and/or a rigid fitment.

In an embodiment, the flexible container 10, 210 has a volume from 0.050 liters (L), or 0.1 L, or 0.15 L, or 0.2 L, or 0.25 L, or 0.5 L, or 0.75 L, or 1.0 L, or 1.5 L, or 2.5 L, or 3 L, or 3.5 L, or 4.0 L, or 4.5 L, or 5.0 L to 6.0 L, or 7.0 L, or 8.0 L, or 9.0 L, or 10.0 L, or 20 L, or 30 L.

3. Flowable Substances

The flexible container 10, 210 can be used to store any number of flowable substances therein. In particular, a flowable food product can be stored within the flexible container 10, 210. In one aspect, flowable food products such as salad dressings, sauces, dairy products, mayonnaise, mustard, ketchup, soy sauce, other condiments, beverages such as water, juice, milk, or syrup, carbonated beverages, beer, wine, animal feed, pet feed, and the like can be stored inside of the flexible container 10, 210.

The flexible container 10, 210 is suitable for storage of other flowable substances including, but not limited to, oil, paint, grease, chemicals, suspensions of solids in liquid, and solid particulate matter (powders, grains, granular solids).

The flexible container 10, 210 is suitable for storage of flowable substances with higher viscosity and requiring application of a squeezing force to the container in order to discharge. Nonlimiting examples of such squeezable and flowable substances include grease, butter, margarine, soap, shampoo, animal feed, sauces, and baby food.

It is specifically intended that the present disclosure not be limited to the embodiments and illustrations contained herein, but include modified forms of those embodiments including portions of the embodiments and combinations of elements of different embodiments as come with the scope of the following claims.

The invention claimed is:

1. A flexible container comprising:

A. four panels adjoined along a common peripheral seal, the common peripheral seal including a first side seal, an opposing second side seal, a top seal and an opposing bottom seal, the four seals forming a chamber;

B. each panel comprising a bottom face, the four bottom faces sealed together to define a bottom section;

C. an upper spout seal extending from the first side seal to the second side seal;

D. a lower spout seal;

E. the upper spout seal and the lower spout seal each comprising a respective spout seal segment and a respective chamber seal segment;

F. the chamber seal segments defining a sealed chamber top; and

G. the lower spout seal segment reciprocally aligned with the upper spout seal segment to form a spout, the spout extending from the sealed chamber top to the second side seal.

2. The flexible container of claim 1 wherein the spout comprises:

a proximate end in fluid communication with the top of the chamber; and a distal end at the second side seal.

3. The flexible container of claim 1 wherein the distal end of the spout comprises an access member.

4. The flexible container of claim 1 comprising a land of panel material above the upper spout seal.

5. The flexible container of claim 4 comprising a cut-out handle in the land.

6. The flexible container of claim 1 wherein each panel is a flexible multilayer film.

7. The flexible container of claim 6 wherein the four panels comprise a first gusset panel, a second gusset panel, a front panel, and a rear panel.

8. The flexible container of claim 1, wherein the flexible container is void of a rigid fitment.

9. The flexible container of claim 1 comprising an overseal in the bottom section and an upper overseal in a top section of the flexible container.

10. The flexible container of claim 1 comprising a reseal structure in the spout.

11. A flexible container comprising:

A. four panels adjoined along a common peripheral seal, the common peripheral seal composed of a first side seal, an opposing second side seal, a top seal and an opposing bottom seal, the four seals forming a chamber;

B. each panel comprising a bottom face, the four bottom faces sealed together to define a bottom section;

C. an upper spout seal extending from the first side seal to the top seal;

D. a lower spout seal;

E. the upper spout seal and the lower spout seal each comprising a respective spout seal segment and a respective chamber seal segment;

F. the chamber seal segments defining a sealed chamber top; and

G. the lower spout seal segment reciprocally aligned with the upper spout seal segment to form a spout, the spout extending from the sealed chamber top to the top seal.

12. The flexible container of claim 11 wherein the spout comprises a proximate end in fluid communication with the top of the chamber; and a distal end at the top seal.

13. The flexible container of claim 11 wherein the distal end of the spout comprises an access member.

14. The flexible container of claim 11 comprising a land of panel material above the upper spout seal.

15. The flexible container of claim 14 comprising a cut-out handle in the land.

16. The flexible container of claim 11 wherein each panel is a flexible multilayer film.

17. The flexible container of claim 16 wherein the four panels comprise a first gusset panel, a second gusset panel, a front panel, and a rear panel.

18. The flexible container of claim 11, wherein the flexible container is void of a rigid fitment.

19. The flexible container of claim 11 comprising an overseal in the bottom section and an upper overseal in a top section of the flexible container.

20. The flexible container of claim 11 comprising a reseal structure in the spout.

* * * * *